US005954443A

United States Patent [19]

Bacon

[11] Patent Number: 5,954,443

[45] Date of Patent: Sep. 21, 1999

[54] METHOD FOR MARKING THE EXTERNAL SURFACE OF A STRAND OF MATERIAL

[76] Inventor: Bruce Allen Bacon, 9263 Sagebrush Trail, Littleton, Colo. 80124

[21] Appl. No.: 08/302,168

[22] Filed: Sep. 8, 1994

Related U.S. Application Data

[63] Continuation of application No. 08/096,704, Jul. 23, 1993, abandoned.

[51] Int. Cl.[6] ..... B43K 5/12; A46B 15/00

[52] U.S. Cl. ..... 401/192; 401/9; 401/11

[58] Field of Search ..... 401/9, 10, 11, 401/12, 16, 17, 192, 194, 193, 198

[56] References Cited

U.S. PATENT DOCUMENTS

| | | | |
|---|---|---|---|
| 439,916 | 11/1890 | Whittlesey | 401/11 X |
| 1,820,583 | 8/1931 | Switzer | 401/198 X |
| 2,095,650 | 10/1937 | Reichenbach | 401/11 X |
| 2,316,040 | 4/1943 | Wirfel | 401/198 X |
| 2,811,732 | 11/1957 | Okamoto | 401/198 X |
| 2,930,061 | 3/1960 | O'Neil | 401/11 |
| 3,062,222 | 11/1962 | Quinn | 401/193 X |
| 3,481,677 | 12/1969 | Abrahamson | 401/198 |
| 4,069,894 | 1/1978 | Black | 401/11 X |
| 4,770,557 | 9/1988 | Pitts | 401/9 X |
| 4,821,748 | 4/1989 | Reas | 401/11 X |
| 5,033,896 | 7/1991 | Lytle et al. | 401/192 X |

FOREIGN PATENT DOCUMENTS

| | | | |
|---|---|---|---|
| 0381818 | 8/1990 | European Pat. Off. | 401/194 |
| 2609666 | 7/1988 | France | 401/192 |

*Primary Examiner*—D Neal Muir

[57] ABSTRACT

An apparatus having a reservoir storing a marking medium, a nib receiving the marking medium for transfer to the surface to be marked, and a guide to locate the strand to be marked in the proper orientation and against the nib. In a method of marking, strands of material are drawn through the guide and over the nib. The marking medium can be a select color for each individual strand to be marked. The reservoir and nib can be combined as part of a single unitary piece or marking element. The marker includes a marker barrel housing the reservoir and nib. The guide can be part of the marker barrel or nib. The marker barrel can be the same color as the marking medium or can have a select pattern for a select color of marking medium. The nib has a marking point extending from the marking barrel. The apparatus includes a removable cap which covers the exposed areas of the nib. The apparatus also includes a means for determining the level of marking medium in the reservoir and a means for replenishing the marking medium in the reservoir.

6 Claims, 1 Drawing Sheet

METHOD FOR MARKING THE EXTERNAL SURFACE OF A STRAND OF MATERIAL

This application is a continuation of the application No. 08/096,704 filed on Jul. 23, 1993, now abandoned.

BACKGROUND

1. Field of the Invention

The present invention relates to a method for marking a longitudinal stripe down an external surface of a strand of material.

2. Description of the Related Art

When a strand of material such as tubing, wire, or rope is used in an application, it is often used in multiple strands. Typically the multiple strands connect to different components. These strands can become tangled making it difficult to see which specific strand connects to which specific component.

An example of this problem can be seen in the medical industry with the use of intravenous solution delivery systems (I.V.). A typical patient may have multiple I.V.s connected to them during a surgical procedure. These I.V.s are connected to the patient by the use of clear flexible tubing. This tubing often becomes tangled making it difficult to trace a tube from the I.V. solution to the patient. Such a problem can result in a life threatening situation for the patient.

One solution is to mark both ends with a label. Although this helps to identify the segment ends, it does not assist the user in tracing a segment through a tangle, or in locating a specific strand midway between the ends. Labels may also be removed accidentally or fall off over time.

Another solution is to manufacture a colored stripe into the product. This practice has been common in the electrical industry and has recently been used by the flexible tubing industry. However, the cost of manufacturing a product with a permanent stripe requires the modification of existing equipment or the purchase of entirely new equipment, adding significantly to the cost of manufacture. Furthermore, a typical application will require multiple strands of material. To meet this requirement, the user must maintain an extensive inventory of strands of material having different colored stripes. A large inventory of strands of material having different colored stripes can be expensive and cumbersome.

For the foregoing reasons, there is a need for an apparatus and method which will mark the external surface of a strand of material such as tubing, wire, or rope, allowing it to be traced through a tangle or to identify a specific strand midway between the ends, that will cost less than manufacturing a permanent stripe into the product, and reduces the inventory necessary to provide different strands of material with different colored markings.

SUMMARY

To overcome the aforementioned shortcomings and deficiencies, the present invention generally provides a method for marking a longitudinal stripe down an external surface of a strand of material. One objective of the present invention is to place a stripe on a strand of material that can be traced through a tangle, or be used to identify a specific strand midway between the ends. Another objective of the present invention is to place a stripe on a strand of material in a manner that costs less than manufacturing a stripe in the product or strand. Yet another objective of the present invention is to be able to place different colors on individual strands from the same stock of material, thereby reducing the inventory of stock required for multiple strand applications.

In one aspect of the present invention, an apparatus has a reservoir, nib, and guide. The reservoir stores a marking medium such as ink, dye, paint or any other suitable material. The nib receives the marking medium from the reservoir and transmits it to the surface to be marked. A guide is used to position the strand of material to be marked in the proper orientation against the nib. The strand of material to be marked can be drawn through the guide and over the nib, thereby placing a longitudinal stripe down the external surface of the strand of material. This stripe can be used to accomplish the objectives of tracing a strand through a tangle or identifying a specific strand midway between the ends. A simple apparatus of this type will cost less for the consumer than expensive machinery necessary to manufacture a stripe in the product, or strand, thereby accomplishes the objective of reducing the cost of placing a stripe in the product strand.

In another aspect of the present invention, the marking medium in the marker is available in different colors. In this manner, a user can stock only one style of product or strand of material and place a unique colored stripe down each individual strand cut from the same stock of product, thereby accomplishing the objective of reducing the inventory necessary for multiple strand applications.

In another aspect of the present invention, the reservoir and nib are components of a combined marking element which can be a single unitary piece.

In another aspect of the present invention, the guide is a component of a marker barrel. The marker barrel also encloses the reservoir and nib. In a further version of this aspect of the present invention, the marker barrel is the same color as the marking medium. In yet a further version of this aspect of the present invention, the marker barrel has a select pattern thereon for each specific color of the marking medium. In yet a further version of this aspect of the present invention, the nib has a marker point extending out of the marker barrel.

In another aspect of the present invention, the guide is a component of the nib. In a further version of this aspect of the present invention, a marker barrel covers the reservoir and nib, and has a notch exposing the guide in the nib. In yet a further version of this aspect of the present invention, the marker barrel in the above version is the same color as the marking medium. In yet a further version of this aspect of the present invention, the marker barrel in the above version has a select pattern thereon for each select color of the marking medium. In yet a further version of this aspect of the present invention, the nib has a marker point extending out of the marker barrel in the above version.

In another aspect of the present invention, a removable cap covers the exposed portions of the nib.

In another aspect of the present invention, the apparatus includes a means for determining the amount of marking medium in the reservoir.

In another aspect of the present invention, the apparatus includes a means for replenishing the marking medium in the reservoir.

OVERVIEW OF THE DRAWINGS

These and other features, aspects, and advantages of the present invention will become better understood with regard to the following description, appended claims, and accompanying drawings where:

DESCRIPTION

Figure 1:
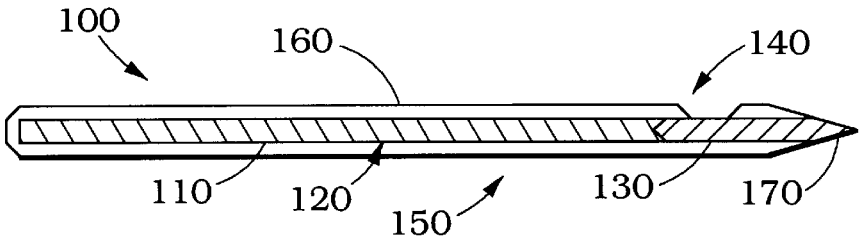
FIG. 1 shows a cross sectional side view of an embodiment of the present invention.

Referring now to the drawings, and more specifically to FIG. 1, there is shown a cross sectional view of the marker 100 constructed in accordance with the principles of the present invention. The marker 100 is generally comprised of a reservoir 110, containing a marking medium 120, a nib 130 receiving the marking medium 120 from the reservoir 110, and a guide 140 located in conjunction with the nib 130 for positioning objects to be marked against the nib 130.

The marking medium 120 can be ink, dye, paint, or any other substance suitable for marking the intended surface. The marking medium 120 can be a select color for a select application of the marker 100. The reservoir 110 can be a compartment, bladder, porous material, or any other means that can accomplish the objective of storing the marking medium 120. The reservoir 110 can be constructed of plastic, metal, wood, open cell foam, or any other material compatible with the marking medium 120. The nib 130 can be constructed of felt, open cell foam, or any other means of receiving the marking medium 120 from the reservoir 110 and transferring the marking medium 120 to the surface to be marked.

The reservoir 110 and nib 130 can be part of a marking element 150. Although FIG. 1 illustrates the marking element as two separate components, the reservoir 110 and the nib 130, it is possible to construct the marking element 150 as a single unitary piece. In constructing the marking element 150 as a single unitary piece, the reservoir 110 and the nib 130 are combined and constructed of felt, open cell foam, or any other means which can accomplish the purposes of both the reservoir 110 and the nib 130.

The guide 140 is located in association with the nib 130 with the purpose of positioning the objects to be marked in the appropriate orientation and location for marking by the nib 130. The guide 140 can be configured as a V-notch, a semicircle, or any other configuration appropriate for orienting and locating the object to be marked in the correct position. The guide 140 can be constructed of plastic, metal, wire, or any other means for accomplishing the purpose of the guide 140.

In the embodiment illustrated in FIG. 1, the guide 140 is a component of a marker barrel 160. The marker barrel 160 houses the reservoir 110 and the nib 130. The marker barrel 160 can be the same color as the marking medium 120, for quick recognition of the color of the marking medium 120, or can have a coded pattern representing a unique use of the object to be marked. The guide 140 is located in the side of the marker barrel 160; however, the guide 140 could also be located in the end of the marker barrel 160. The location of the guide 140 within the marker barrel 160 is only limited by the requirement of meeting the purposes of the guide 140.

Also shown in the embodiment illustrated in FIG. 1, a marker point 170 that is part of the nib 130, extends out of the marker barrel 160. The purpose of the marker point 170 is to allow marking an object when it is not necessary to use the guide 140. An example of a use for the marker point 170 would be to write on the label of an I.V. with the same marker used to mark the tubing of the I.V.

Figure 2:
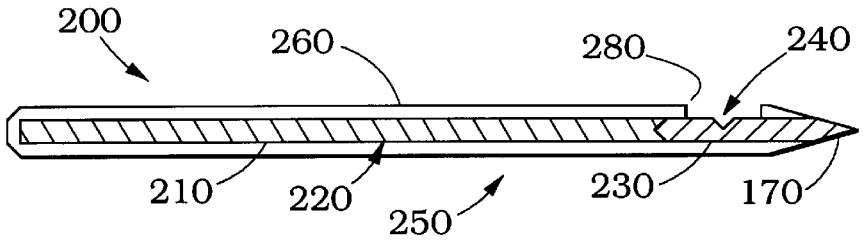
FIG. 2 shows a cross sectional side view of an alternate embodiment of the present invention.

Referring now to FIG. 2, there is shown a cross sectional view of an alternate embodiment of the present invention. In FIG. 2, the marker 200 generally comprises a reservoir 210 containing a marking medium 220, a nib 230 for receiving the marking medium 220 from the reservoir 210 and conducting it to the object to be marked, and a guide 240 located in conjunction with the nib 230 for the purpose of positioning object to be marked against the nib 230.

The reservoir 210, marking medium 220, and nib 230 are similar to, and perform the same functions as, the corresponding components of the marker 100 illustrated in FIG. 1. The reservoir 210 and nib 230 can be part of a marking element 250. Similar to the marker 100 in FIG. 1, the marking element 150 can be a single unitary piece combining the functions of the reservoir 210 and the nib 230.

The guide 240 serves the same purpose and function as the guide 140 illustrated in FIG. 1; however, the guide 240 is part of the nib 230. A marker barrel 260 serves the same purpose and function as the marker barrel 160 illustrated in FIG. 1, with the exception of the marker barrel 260 comprises a notch 280 instead of a guide. The notch 280 is used to expose the guide 240 in the nib 230 for the purpose of orienting, locating, and marking objects. Although the guide 240 is shown as being in the side of the nib 230 which exposed by the notch 280 in the marker barrel 260, the guide 240 could also be located in a portion of the nib 230 extending from the end of the marker barrel 260.

The marker barrel 260 can be colored or have a pattern similar to the marker barrel 160 illustrated in FIG. 1. Also, the nib 230 can have a marker point 270 which extends from the marker barrel 260. The marker point 270 is similar to, and has the same purpose and function as, the marker point 170 illustrated in FIG. 1.

Figure 3:
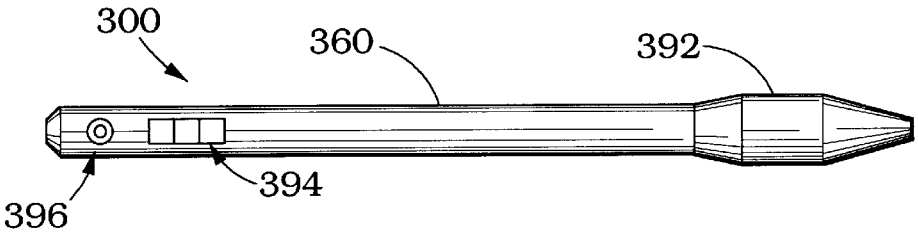
FIG. 3 shows the embodiment in either FIG. 1 or FIG. 2 with further features of the present invention.

Referring to FIG. 3, there is shown the marker 100 from FIG. 1 or the marker 200 from FIG. 2, further illustrating features of the present invention. As shown in FIG. 3, the marker 300 has a cap 392 covering the areas of the nib left exposed by the marker barrel 360. The cap 392 can be constructed of plastic, metal, or any other appropriate material.

A level indicator 394 is located in the marker barrel 360 for determining the amount of marking medium remaining in the reservoir. In the illustration for FIG. 3, the level indicator 394 is a window into the reservoir and markings used to indicate the amount of marking medium remaining; however, the level indicator 394 can be any means for accomplishing the purpose of the level indicator 394.

Figure 4:
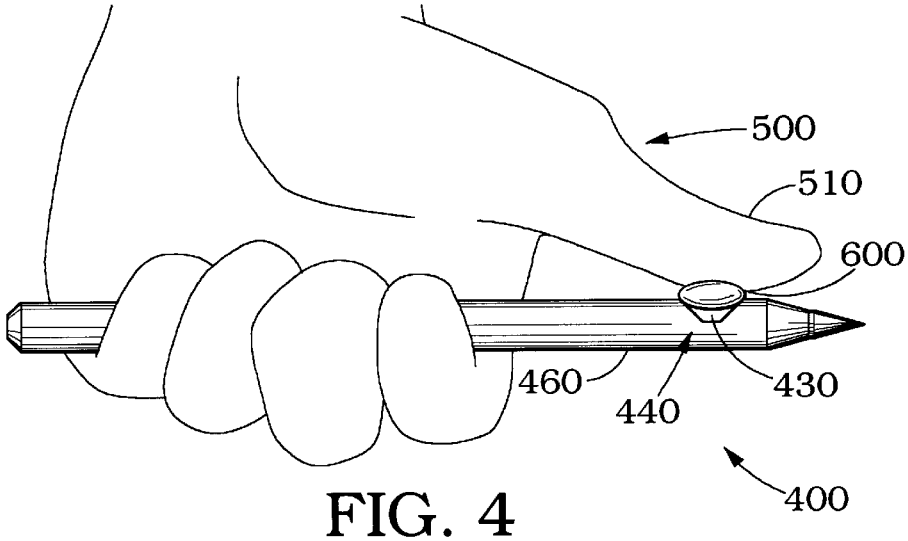
FIG. 4 shows a method of the present invention.

A refilling port 396 is also located in the marker barrel 360 for replenishing the marking medium in the reservoir. In the illustration of FIG. 3, the refilling port 396 is a check valve; however, the refilling port 396 can be any means for accomplishing the purposes of the refilling port 396. Referring now to FIG. 4, there is shown a method of the present invention for marking objects. A marker barrel 460 of a marker 400 is firmly held in a users's hand 500. A strand of material 600 is positioned in a guide 440 of the marker 400 and against the nib 430 of the marker 400. A thumb 510 of the users's hand 500 secures the strand of material 600 in the guide 440 and against the nib 430 as the strand of material 600 is drawn linearly through the guide 440 and across the nib 430. As the strand of material 600 passes over the nib 430, a longitudinal stripe is placed down the external surface of the strand of material.

In this manner, a user can quickly mark a colored line on any external surface of a strand of material such as tubing, wire, or rope. The marked line will allow a user to trace the strand through a tangle or to identify a strand midway between the ends. The present invention can place a stripe on a strand of material at a lower cost than many available methods of manufacturing a stripe in the product. Also, by having a plurality of markers available in different colors, a user can mark different colors on strands of material from the same stock thus reducing the inventory of material necessary to provide individual strands of material with different colored stripes.

While preferred embodiments of the present invention have been shown and described herein, it will be obvious that such embodiments are provided by way of example only. Numerous variations, changes, and substitutions will occur to those skilled in the art without departing from the invention herein. Accordingly, it is intended that the invention be limited only by the spirit and scope of the appended claims.

What is claimed is:

1. A method for marking a longitudinal stripe on an external surface of a flexible strand of material, said method comprising the steps of:

providing a marking element;

providing said marking element with a marking medium;

providing a housing partially enclosing said marking element, said housing having a guide being located in association with said marking element so as to position the external surface of said flexible strand of material in a select orientation against said marking element when said flexible strand of material is positioned against said guide;

positioning said flexible strand of material against said guide with the external surface of said flexible strand of material in said select orientation against said marking element;

drawing said flexible strand of material through said guide while positioning said flexible strand of material against said guide, wherein said marking element places a longitudinal stripe of said marking medium on the external surface of said flexible strand of material.

2. The method as set forth in claim 1, wherein said step of providing said marking element with said marking medium includes providing said marking element with said marking medium having a select color for a select purpose of said flexible strand of material.

3. The method set forth in claim 1, wherein said step of providing said marking element includes providing said marking element with a marker end, and wherein said step of providing said housing includes providing said housing with said marker end of said marking element extending from said housing and being exposed for marking surfaces.

4.The method as set forth in claim 1, wherein:

said step of providing said marking element includes providing said marking element with a nib and a reservoir, and said nib adapted for receiving said marking medium from said reservoir;

said step of providing said marking element with said marking medium includes providing said reservoir of said marking element with said marking medium;

said step of providing said housing includes providing said housing partially enclosing said marking element, said housing having said guide being located in association with said nib of said marking element so as to position the external surface of said flexible strand of material in a select orientation against said nib of said marking element when said flexible strand of material is positioned against said guide;

said step of positioning said flexible strand of material against said guide includes positioning said flexible strand of material against said guide with the external surface of said flexible strand of material in said select orientation against said nib of said marking element; and said step of drawing said flexible strand of material through said guide includes drawing said flexible strand of material through said guide while positioning said flexible strand of material against said guide, wherein said nib of said marking element places a longitudinal stripe of marking medium on the external surface of said flexible strand of material.

5. The method as set forth in claim 4, wherein said step of providing said reservoir with said marking medium includes providing said reservoir with said marking medium having a select color for a select purpose of said flexible strand of material.

6. The method according to claim 4, wherein said step of providing said nib includes providing said nib with a marker end, and wherein said step of providing said housing includes providing said housing with said marker end of said nib extending from said housing and being exposed for marking surfaces.

* * * * *